US005340034A

United States Patent [19]

Jang

[11] Patent Number: 5,340,034

[45] Date of Patent: Aug. 23, 1994

[54] PAPER GRINDER

[76] Inventor: Seong J. Jang, 120 Hedley Ave., Central Falls, R.I. 02863

[21] Appl. No.: 77,666

[22] Filed: Jun. 18, 1993

[51] Int. Cl.[5] ..... B02C 18/22

[52] U.S. Cl. ..... 241/3; 241/101.4; 241/159

[58] Field of Search ..... 241/3, 101.4, 159, 236

[56] References Cited

U.S. PATENT DOCUMENTS

| | | | |
|---|---|---|---|
| 819,862 | 5/1906 | Cutler | 241/101.4 |
| 1,110,218 | 9/1914 | Mayer, Jr. | 241/159 X |
| 1,561,093 | 11/1925 | McCargar | 241/101.4 X |
| 2,123,207 | 7/1938 | Rosenthal | 241/3 X |
| 2,686,466 | 8/1954 | Lee | 241/101.2 X |
| 3,580,516 | 5/1971 | Spencer | 241/3 X |
| 3,637,146 | 1/1972 | Banks | 241/3 X |
| 4,124,169 | 11/1978 | Hatanaka | 241/101.4 |
| 4,619,411 | 10/1986 | Izzard | 241/101.4 |

*Primary Examiner*—Mark Rosenbaum
*Assistant Examiner*—Frances Han
*Attorney, Agent, or Firm*—Robert J. Doherty

[57] ABSTRACT

Method and apparatus for producing paper powder from paper-like sheet material by initially corrugating the sheet material so as to stiffen it and thereafter while so stiffened repeatedly impacting it so as to pulverize it into powder.

6 Claims, 4 Drawing Sheets

PAPER GRINDER

BACKGROUND AND OBJECTS OF THE INVENTION

This invention relates to a paper grinder and the method of grinding paper thereby. In that regard, it should be noted that the term "paper" includes such related paper-type products such as paperboard, cardboard and the like which are generally in the form of planar sheets.

It is well known to cut or shred paper or paper-like documents so as to obliterate their content. Such conventional shredding produces shredded paper product strips which have virtually no secondary use. In fact, most of such shredded paper has to be disposed with other waste and adds to ecological problems. Examples of such paper document shredders are disclosed in U.S. Pat. No. 2,686,466 issued Aug. 17, 1954 and U.S. Pat. No. 4,124,169 issued Nov. 7, 1978 to Lee and Hatanaka respectively.

Accordingly, it would be desirable to be able to simultaneously not only dispose of waste paper including documents to obliterate their content but additionally form a useful product. Thus while shredded paper as above indicated has virtually no use, paper powder can be used in many different ways including the construction field in which powder can be further treated with flame retardants, for instance, to form cellular insulation or combined with other materials to form paper pulp which can then be formed into constructional panels, for instance, for use in ceiling tiles. In addition, paper powder has significant use in the arts and crafts field, for instance, for the formation of paper paste as in combination with glue and colorants to produce simulated bark for bonsai trees or the formation of papier-mâché products such as decorative trays and the like.

Also, it would be desirable to produce a paper grinder which, unlike available paper shredders which produce strips or shreds of documents the content of which can be painstakingly reassembled to enable the content to be at least partially deciphered, would absolutely obliterate the contents of documents.

Accordingly, a primary object of the present invention is the provision of a novel paper grinder which directly forms paper powder without the necessity of intermediate steps.

Another object of the present invention is the provision of a paper grinder which absolutely obliterates the content of documents such that they could never be even partially reassembled.

A further object of the present invention is the provision of a paper grinder which has operational flexibility in its ability to accept various sizes and thicknesses of paper and paper-like products and yet which is of simple, straightforward construction and of generally low cost.

A still further object of the present invention is the provision of a paper grinder which operates in a unique such that it accepts very lightweight paper sheets and directly grinds such to powder without the necessity of otherwise supporting them prior to or during impact.

These objects are accomplished by the provision of a paper grinder which initially corrugates the incoming paper sheets to temporarily stiffen them prior to contact by a rotating impact wheel which progressively contacts the leading edge of the paper as it serially moves through the device.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contempted for carrying out the present invention.

DETAILED DESCRIPTION OF THE INVENTION

Figure 1:
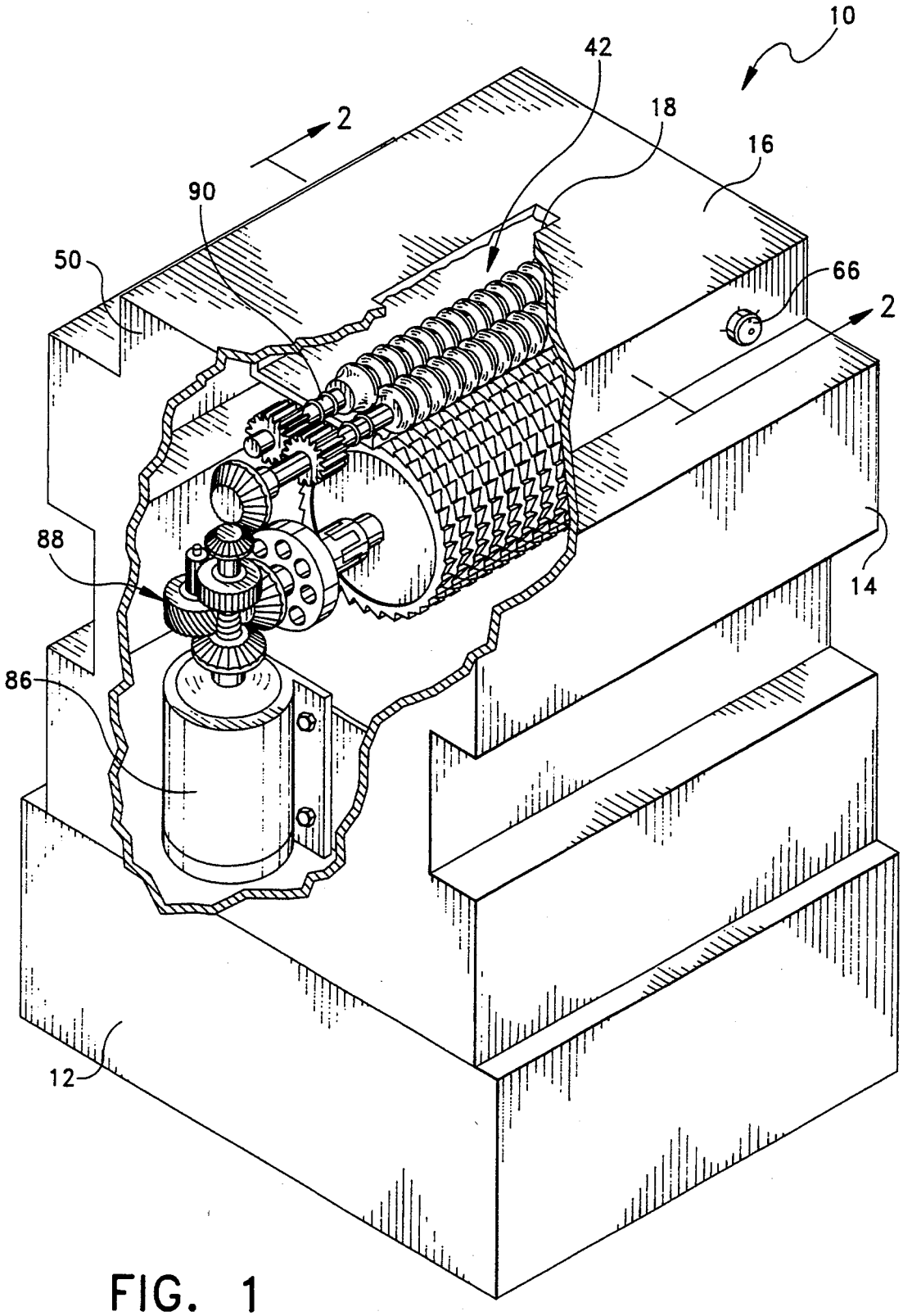
FIG. 1 is a front perspective view of a paper grinder made in accordance with this invention with parts broken away to show the operational features thereof.

Turning now the the drawings and particularly FIG. 1 thereof, the grinder 10 of the present invention includes a base or housing 12 of any suitable configuration but generally forming a rectangular box having walls and a hollow interior for receipt and storage of ground paper powder produced by the operational aspects of the device and in turn serving as a support for such operational aspects.

The housing 12 further includes an upper segment 14 which in turn includes a cover 16 having a rectangular slot 18 for the receipt, that is, for the feeding, of paper sheet thereinto. Such sheet normally takes the form of a planar piece of paper 20 having opposed upper and lower surfaces 22 and 24 respectively and a leading edge 26. It is the leading edge 26 as it is fed into the device that progressively becomes stiffened by production of sinuous corrugations 26*a* temporarily formed therein. These corrugations are in a plane transverse to the generally planar extent of the sheet 20 and, accordingly, tend to stiffen the sheet such that when impacted by a rotating roller or wheel having projecting knives or surfaces from its peripheral surface or even its edge surfaces tends to pulverize and shatter the paper as it progressively moves into the impact surface rather than deflecting, shredding or tearing such as would more likely be the case should the sheet 20 be fed in an unstiffened more flexible or flimsy state. Thus the corrugations 26*a* provide a lateral stiffening for temporary rigidity to the leading edge of the sheet 20 as it is contacted by the impact wheel.

Figure 2:
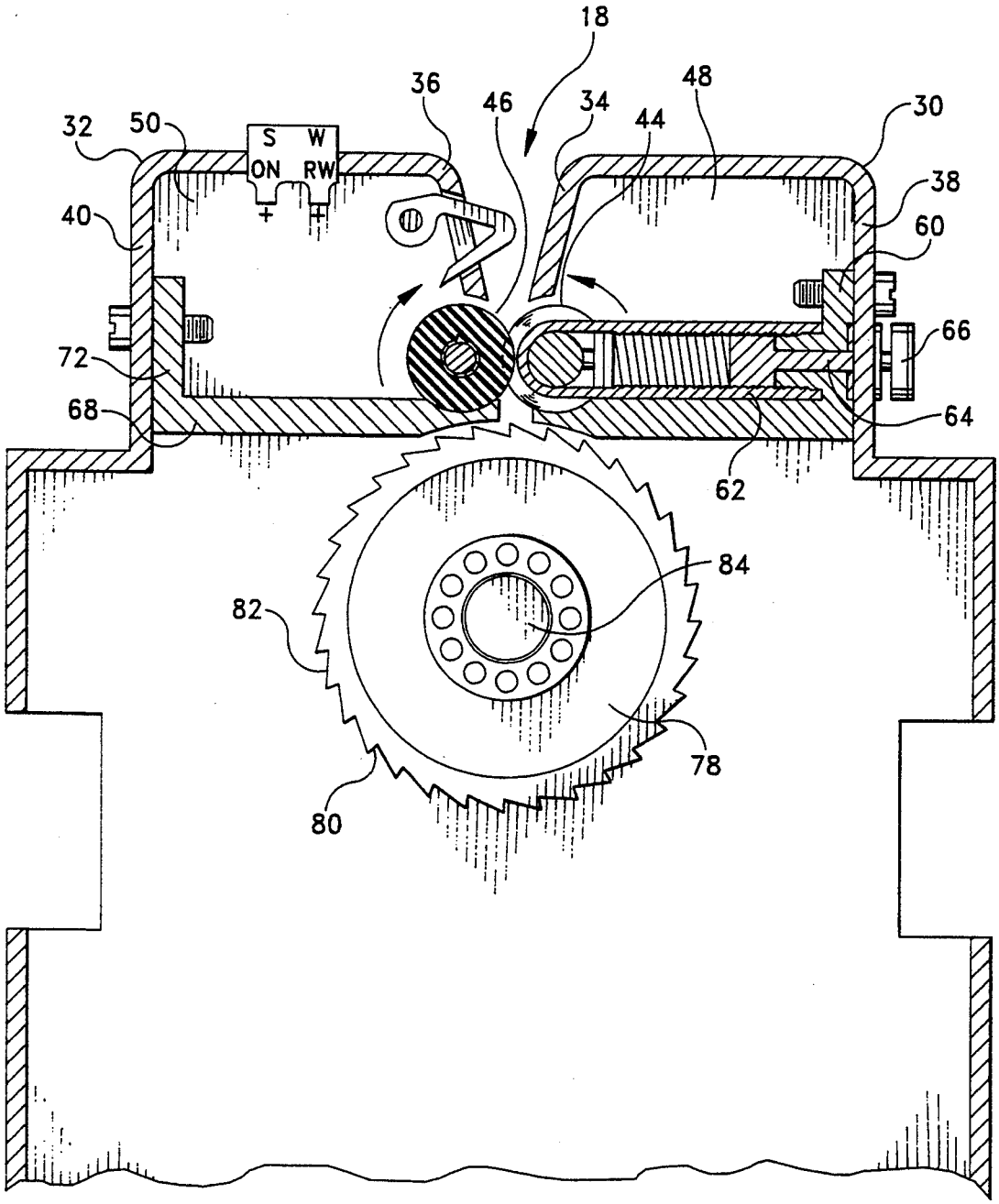
FIG. 2 is a partial side sectional view thereof taken along the line 2—2 of FIG. 1.
Figure 3:
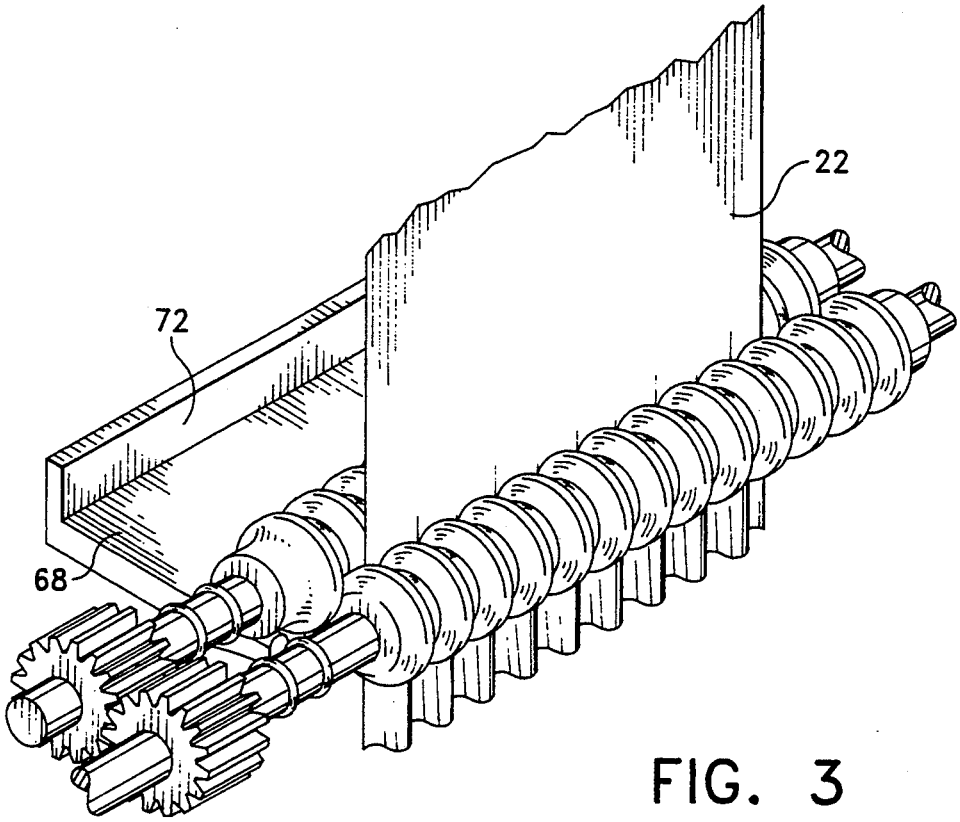
FIG. 3 is an enlarged exploded view of the sheet corrugating rolls and a support shelf therefore.
Figure 4:
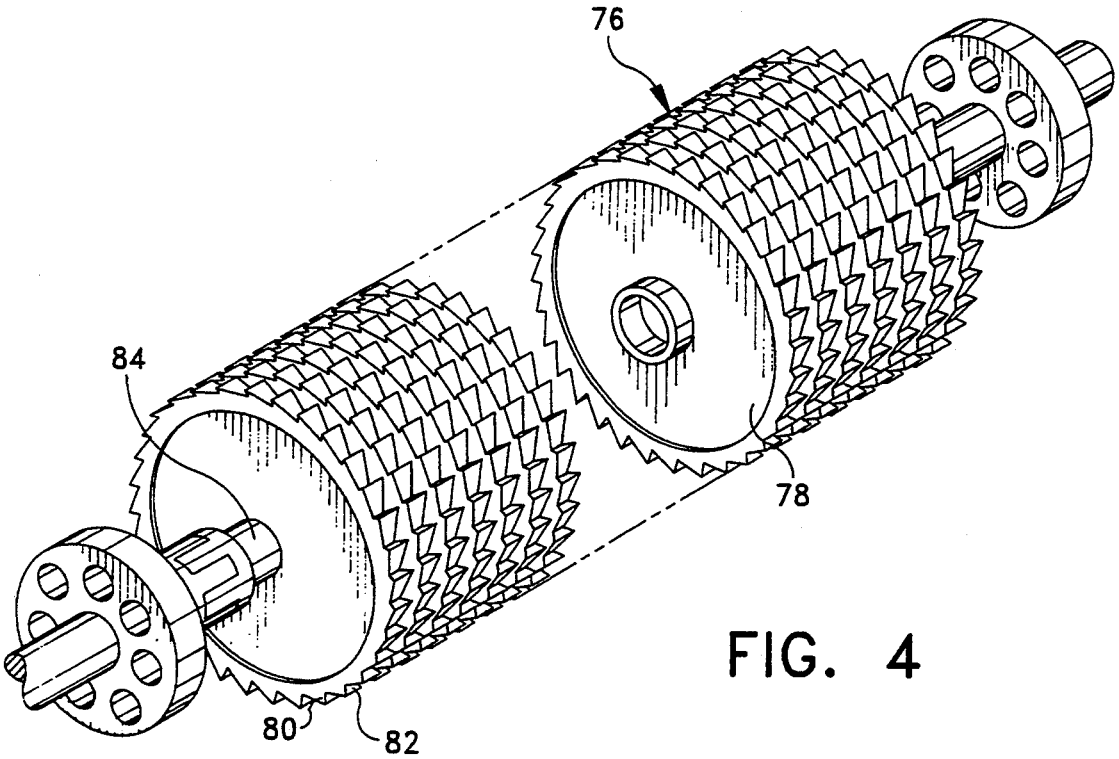
FIG. 4 is a partial view of the impact or grinding roll.
Figure 4A:
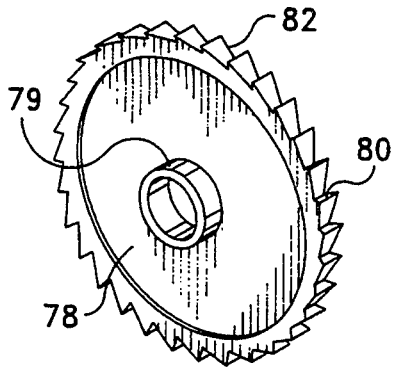
FIGS. 4*a* and 4*b* are partial views of one or more of the the grinding drum segments shown in FIG. 4.
Figure 4B:
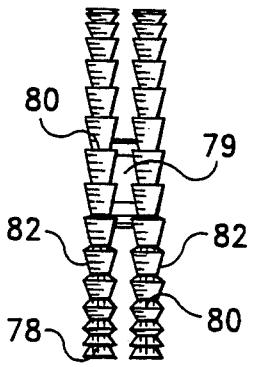
Figure 5:
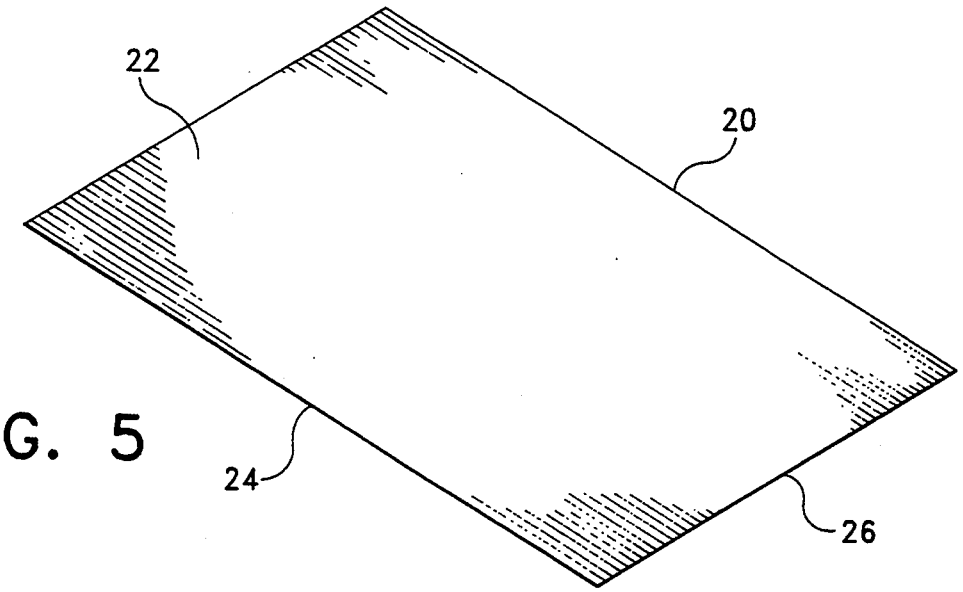
FIGS. 5 and 5*a* are top perspective views of sheet material in normal and corrugated configurations respectively.
Figure 5A:
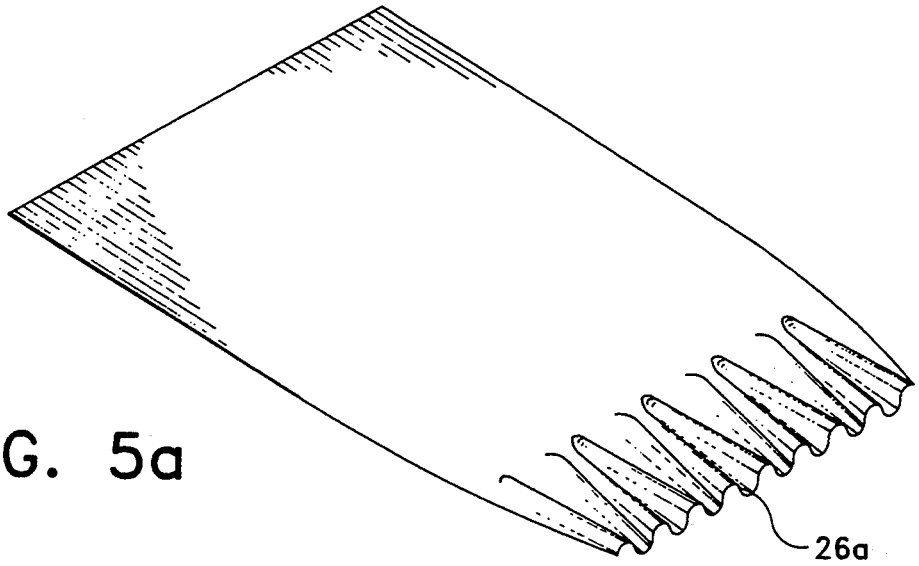

The cover 16 includes a forward cover portion 30 and a rear cover portion 32 which are best shown in FIG. 2 disposed such that they face each other and terminate in downwardly extending walls 34 and 36 respectively. Such walls 34 and 36 are downwardly inwardly tapered so as to form the inlet slot 18 for receipt of the paper sheets 20. The opposite walls 38 and 40 of the segments 30 and 32 respectively in turn are adapted to support corrugation station 42 in the following manner: The corrugation station 42 includes a pair of corrugating rolls 44 and 46 suitable supported for rotation in opposite directions to each other as by being journaled into or other suitable fitment to opposed side walls 48 and 50 of the top segments 30 and 32 respectively. For most hobby or office needs, corrugating rolls which are generally sinuous in cross section and approximately ¾ inch diameter at their widest points and approximately ½ inch in their narrowest has found suitable. Such configuration will reform the leading edge 26 of the sheet 20 into a sinuous configuration exhibiting nodes which are approximately ⅛ inch in height.

It should be further brought out that the corrugating rolls 44 and 46 are generally of equal height and spacing such that they may be displaced in interdigitated relationship to each other, that is, the successive high points of one roll arranged so as to mate with the successive low points of the other roll and spaced apart from each other a distance at least equal to or preferably slightly greater than the sheet material 20 width to be fed therein. In this regard, the forward corrugating roll 44 is mounted via support arm 60 and is adjustable in a front to rear direction by means of a pair of threaded rods 62 suitable engaged in a channel 64 in turn adapted to engage spaced lateral portions of the roll 44 to open or close the gap between the corrugating rolls 44 and 46 via a pair of adjustment wheels 66 extending outwardly from the front wall 38 of the front segment 30 of the cover 16. Other suitable mechanical adjustment arrangements may be utilized so long as appropriate adjustment between the corrugating rolls and 46 is brought about so that the gap therebetween can be adjusted to receive either multiple thicknesses of sheet material 20 or sheet material 20 which is thicker than normal paper sheets, i.e., paperboard, cardboard and the like.

The other corrugated roller 46 is supported for rotation as by journaling in bearings provided in opposed side walls 50 and in additional is supported by a shelf 68 having a plurality of grooves 70 adapted to receive the corrugations of roller 46 therein. Such shelf includes a bracket 72 which in turn is bolted or otherwise secured to the rear wall 40 of the cover segment 32.

Mounted directly below the corrugated rollers 44 and 46 is an impact roller or grinding drum 76 preferably made up from a series of individual cutting plates 78 mounted in spaced side by side relationship as by blocks 79 and which exhibit a plurality of circular teeth 80 but in addition a plurality of laterally extending teeth 82 as well. A convenient manner of forming drum 76 is to assemble a plurality of circular saw blades in a stack with spacing washers between adjacent blades. It should be pointed out that the directional term such as "mounted below" are relative, and the important aspect of the impact roller 76 mounting vis-a-vis the corrugating rolls 46 and 44 is that the roller 76 forming the impact station should be downstream of the corrugating station and in alignment with the paper sheet travel as guided by the slot 18 and the relative rotation of the rolls 44 and 46.

Such drum 76 includes a central shaft 84 which is mounted for rotation relative to the housing 12 and supported thereby as by the provisions of bearings and the like. A motor 86 is suitable mounted to the inside of the upper portion of the housing 14 and through a suitable gear train 88 enables both rotation of the corrugated rolls 44 and 46 as well as the drum 76. Suitable operational and safety switches for the on/off and unjamming of the machine including a reverse are suitably provided.

It is important that the rollers 76 be mounted immediately below the nip of the corrugated rollers 44 and 46 such that in operation the sheet material 20 is fed through the slot 18 and gripped by the opposite rotation of the rollers 44, 46 rotating in the direction of the arrows shown. Such rollers cooperate to corrugate the leading edge 26 of the sheet 20 to form corrugations **26*a* therein. Such temporary corrugations 26*a* stiffen the sheet 20 leading edge and while so corrugated and thus stiffened are subjected to immediate impact by the drum 76**.

A suitable RPM for the drum has been found to be 1500 revolutions per minute but as with the sizing and relative configuration of the corrugating and impact rollers such to some extent is dependent upon the material being processed. It is also important that the surface of the corrugating rollers 44 and 46 be non-slip material and a hard rubber compound formed in the desired configuration and frictionally mounted upon a steel shaft 90 has been found suitable for the purpose.

Operation of the device preferably includes maintaining contact of trailing portions of the sheet 20 while the corrugated leading portions thereof are impacted by the rotating grinding drum 76 so as to maintain the corrugated or sinuous shape of the leading edge 26 while being impacted. Of course, it is contemplated that other mechanisms for maintaining the stiffness afforded by the corrugations **26*a* could be conceivably used but are not contemplated herewith. Preferably the continuous and to some extent overlapping feed of sheets 20 into the slot 18 assures that intermediate or trailing sheet portions are to some extent held in the cooperating nip of the corrugating rollers 46, 44 while the leading edge of the corrugated and thus stiffened sheet is being impacted by the drum 76**.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. The method of grinding paper and paper-like products including paperboard and cardboard which are in the form of generally planar sheets having a leading edge comprising feeding such sheet-like material to a corrugating station in which said leading edge of said sheet material is longitudinally corrugated in a direction normal to its planar extent so as to stiffen such sheet material and thereafter immediately feeding such stiffened sheet material to an impact station wherein said stiffened sheet is repeatedly impacted in said normal direction so as to pulverize portions of said sheet adjacent said leading edge into paper powder wherein said corrugating station includes a pair of opposed rolls each having undulating surfaces, which undulating surfaces in turn interdigitate with respect to each other and contact opposed surfaces of said sheet material so as to longitudinally corrugate said sheet and maintaining said corrugating contact on said sheet material while impacting said sheet leading edge.

2. The method of claim 1 wherein said sheet material is continuously fed from said corrugating station to said impacting station.

3. The method of claim 1, including maintaining said sheet in contact with said corrugating station while serially contacting progressive portions of said leading edge in said impact station.

4. A device for grinding paper and paper-like products including paperboard and cardboard which are in the form of generally planar sheets having a leading edge comprising a generally enclosed housing including a longitudinally oriented impacting drum having a peripheral surface and a plurality of cutting surfaces outwardly extending from said peripheral surface supported for rotation along a longitudinal axis by said housing, said housing further including a longitudinally oriented feed slot for serial receipt of said sheets and a corrugating station disposed between said slot and said drum for corrugating said sheets in a longitudinal direction prior to contact by said drum, said corrugating station comprising a pair of longitudinally oriented sinuously shaped rolls mounted in said housing for face to face rotation along their longitudinal axis and disposed immediately adjacent to said drum and wherein said rolls each have undulating surfaces which undulating surfaces in turn interdigitate with respect to each other in said longitudinal direction and also contact opposed surfaces of said sheet material to longitudinally corrugate such sheet material so as to stiffen such sheet material.

5. The device of claim 4, said corrugating rollers having outside surfaces formed of relatively high friction material for non-slip contact with said sheets on opposite sides thereof.

6. The device of claim 4, said impact drum comprising a plurality of circular saw blades longitudinally assembled in a stacked relationship to each other and including separating means disposed between adjacent blades to longitudinally space such from each other.

* * * * *